United States Patent [19]

Reich

[11] 4,051,793

[45] Oct. 4, 1977

[54] EMBROIDERY MACHINE

[76] Inventor: Rudolf Reich, Neuwied, Germany

[21] Appl. No.: 665,343

[22] Filed: Mar. 9, 1976

[51] Int. Cl.[2] ..... D05C 3/04

[52] U.S. Cl. ..... 112/83

[58] Field of Search ..... 112/78, 83, 84, 90, 112/86

[56] References Cited

U.S. PATENT DOCUMENTS

| | | | |
|---|---|---|---|
| 3,092,054 | 6/1963 | Marschik | 112/83 |
| 3,177,834 | 4/1965 | Urscheler | 112/83 |
| 3,349,733 | 10/1967 | Ree | 112/83 |
| 3,377,969 | 4/1968 | Reich | 112/83 |
| 3,680,505 | 8/1972 | Reich | 112/83 |
| 3,884,165 | 5/1975 | Tajima | 112/83 |
| 3,937,161 | 2/1967 | Reich | 112/83 |

*Primary Examiner*—Alfred R. Guest

*Attorney, Agent, or Firm*—Michael P. Breston

[57] ABSTRACT

In an embroidery machine, especially an area embroidery machine, the embroidering heads of embroidering stations, which are arranged one above the other, are adjustably mounted on basic guides which extend over the entire height of the embroidering field, in such a manner that the embroidering tools on the needle side and on the shuttle side of each embroidering station are movable synchronously to each other relative to the embroidery field, individually, in groups, or in their entirety. The basic guides on the needle side and on the shuttle side are movable relative to the embroidery field. The embroidering tools are mounted on the basic guides by interconnecting adjustment bars; the relative position of the adjustment bars in view of the basic guides is adjustable on the needle side and on the shuttle side.

22 Claims, 19 Drawing Figures

Fig. 1
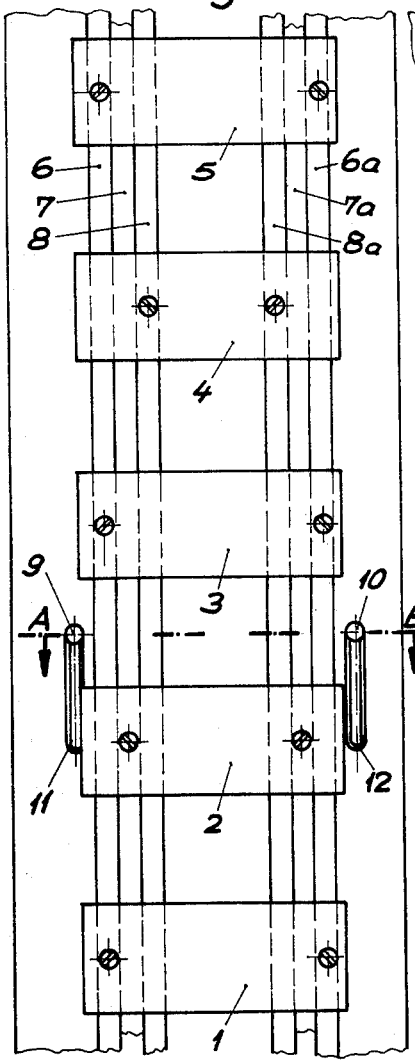
Fig. 2
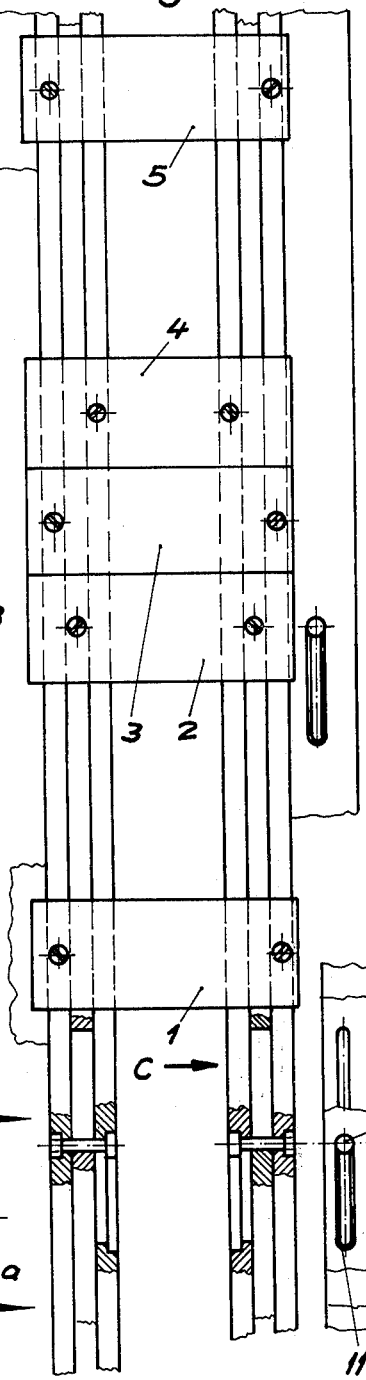
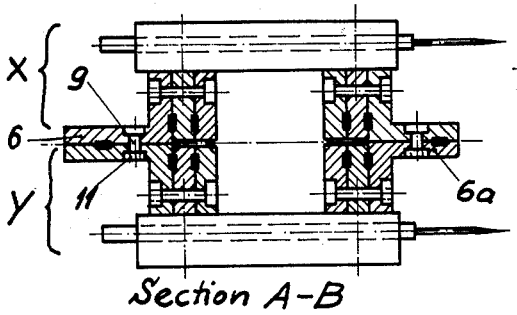
Fig. 3
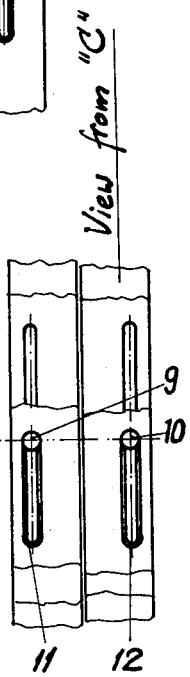
Fig. 4

Section E-F

Section G-H

Section I-K 126
125a
125
124a
124
132
127
131
128
130
129

133
134
135
136
137
138
139
140
141
142
143
144

EMBROIDERY MACHINE

This invention refers to embroidery machines, esp. area embroidery machines, with which the embroidering tools on the needle side of each embroidering station are combined to an embroidering head, and the embroidering heads of those embroidering stations, which are arranged on one upon the other, are adjustably mounted to a common basic guide which extends over the height of the embroidery field.

BACKGROUND OF THE INVENTION

With embroidery machines it has been proposed to combine the embroidering tools of one embroidering station with embroidering heads and to mount the embroidering heads on basic guides, which extend over the height of the embroidery field. With said machines the embroidering tools on the needle side, as embroidering needles, piercers, fabric pressers and the like are combined into an embroidering head, whereas the embroidering tools on the shuttle side, as grippers or shuffles are mounted in an independent casing on corresponding basic guides, which extend also over the height of the embroidering station as well the position of the embroidering head supporting the embroidering tools on the needle side as also the position of the casing supporting the grippers or alternatively the shuttles are to be changed and because both groups of embroidering tools are to be readjusted relative to each other, changing the relative position of the embroidering station in view of the embroidery field requires extremely high expenditure. For the time period which is required in order to perform a corresponding change the entire embroidery machine is to be stopped, which automatically results in a high production loss. From this reason, up to now users of said machines have refrained from changing the relative position of the individual embroidering station inview of the embroidery field, e.g. in view of forming patterns but rather have chosen to pass through the embroidery material several times in order to vary the embroidery pattern.

The following U.S. Patents of the applicant in the field of area embroidery machines indicate the state of the art in said field:

U.S. Pat. No. 3,377,969 filed on Oct. 10, 1965
U.S. Pat. No. 3,680,505 filed on Aug. 18, 1970
U.S. Pat. No. 3,937,161 filed on July 3, 1974.

SUMMARY OF THE INVENTION

This invention is based on the object to provide an embroidery machine the embroidering positions of which are variable in view of their relative position before and also during the embroidering procedure in order to vary the embroidery patterns.

This object is solved according to this invention in that the embroidering tools on the needle side and on the shuttle side of each embroidering station are movable synchronously to each other relative to the embroidery field. The embroidering tools on the needle side and on the shuttle side are arranged in such a manner that they are movable either individually, or in groups or in their entirity. By adjusting the embroidering tools of each embroidering station on the needle and on the shuttle side synchronously it is possible to derive the common adjusting movements of the tools belonging to the embroidering station from an information program carrier allowing for the first time to use the change of position of the embroidering stations for varying the embroidery pattern to be produced which was not possible with embroidery machines known up to now.

With embroidery machine with which the embroidering tools of a plurality of embroidering stations arranged one above the other on the needle side and on the shuttle side each are taken up in a common basic guide, a change of position of the embroiderying stations can be obtained in a simple structural manner in that the basic guides are arranged movable relative to the embroidery field; preferably the movability is chosen to be continuous. In this manner it will be possible by means of a simple adjusting movement of that pair of basic guides supporting the embroidering tools to switch over from a e.g. rectilinear line arrangement of the embroidering station to a wavelike or a zigzag like line arrangement of the embroidering stations.

The variability of the embroidery patterns obtained by varying the position of the basic guides for the embroidering tools on the needle side and on the shuttle side can be multiplied by providing the drive of those embroidering stations which are arranged on a pair of basic guides, being adjustable in common, to be switched on and off. In this manner it is possible to start from a basic pattern and to obtain within a single embroidery field a plurality of different designs (so far as it concerns the outer appearance) by means of a single passage of the information program carrier. Because embroidering the individual patterns of pattern elements can be made in a continuous sequence which means that any turning or reclamping of the embroidery material can be completely dispensed with, the performance of an inventive machine is essentially higher than the performance of machines known up to now.

A corresponding completely new pattern technique allows to reduce the high expenditure in view of costs and labour for producing the information program carrier, e.g. cards or the like.

In order to be able to vary the embroidery pattern not only within the used basic repeat according to further embodiments of the invention the embroidering tools are indirectly mounted on the basic guides. Said indirect type of mounting will be obtained f.i. by mounting the embroidering tools by interconnecting adjusting bars at the basic guides and by varying the position of the adjusting bars relative to the basic guides.

This allows further possibilities for varying the embroidery pattern in that the embroidering tools at the adjusting bars are adjustably mounted.

The inventive proposal to make the basic guide which supports several embroidering stations arranged one above the other, and also the embroidering stations relative to their basic guides variable in view of their position allows as well a variation of the type of pattern as also of the size of pattern so that the position of each embroidering station of a basic guide can be used for varying the patterns to be produced. As this is basically true for all basic guides or alternatively for all embroidering stations supported by said basic guides in the same manner according to this invention practically all embroidering stations of an area embroidery machine can be used for varying the embroidery pattern to be produced so that the variability of patterns can be increased substantially in a single passage of the information program carrier.

Coupled with the control apparatus the adjusting bars can be arranged as pairs of adjusting bars adjustable in their height at the position required by the designer and are operated automatically by means of corresponding control members. E.g. the driving action is obtained by hydraulic step motors, by means of which toothed racks are moved across the full width of the machine on basic guides in a linear manner so far as the height adjustment of the pairs of adjustment bars being provided on the corresponding tooth rack with the embroidering heads supported thereon makes it necessary with respect to the pattern. The measure of the height adjustment is determined by the designer from the beginning by means of the information program carrier. Instead of a hydraulic step motor drive also changeable step pulleys or cam devices can be used, whereby for each pair of adjusting bars a corresponding cam wheel is to be provided, and the cam wheels are arranged on a common shaft and are switched by means of an information program carrier.

The embroidering heads at the embroidering head side are arranged one above the other on a continuous toothed shaft; at the shuttle side not only the shuttle casing is to be arraned adjustable in height by means of the pair of adjusting bars but rather the shuttles provided within the shuffle casing each are driven by means of an upper driver and a lower driver. The problem caused by the adjustment operation is by far more complicated at this side. According to the shuttle stroke shuttle casing and driver bar are to be moved with the upper drivers and the lower drivers to the required measure of height adjustment. Furthermore, it will be necessary to divert the axial, oscillating path obtained from the main drive of the machine into a straight-line vertical movement. Again, preferably hydraulically operated step motors and transmitting shafts, couplings and the like are used.

According to a further embodiment of this invention dependent on the requirements of the pattern basic guides supporting embroidering heads are switched on and off in order to obtain additional pattern effects and other requirements known in the embroidery field (e.g. hang-up edges for discharge material) by means of the information carrier. It is not neccessary that all basic guides of shuttles, thread supply means and embroidering heads are switched off during the embroidering step within an embroidery field. E.g. the basic guides of shuttles and thread supply means are able to continue running in a normal manner; they do not deliver a thread as long as the needles do not stitch into the embroidery ground and take the thread along. Therefore, only the needle basic guide is to be switched on and off.

Therefore, according to this invention the drive shaft for needle and piercer is provided by means of an intermediate member, e.g. a clutch coupling, and the shaft is interrupted and switched on again through the main drive of the machine at any time. For each individual drive of a basic guide, therefore, a clutch coupling or a corresponding member will be provided. Said coupling is arranged on a shaft transversely to the embroidery machine width and is movable on said shaft. Preferably a three-arm lever is provided one arm of which engages the coupling and a second arm is connected with a control drive which is operated upon by the information carrier; the information carrier is programmed in such a manner that the basic guides are switched off according to said program. In order to allow the drives to operate again synchronously with the remaining embroidering heads when the coupling is switched on again the third arm is provided with locking means for the coupling or alternatively the drive; this allows to retain the shaft in its starting position until it is switched on again. It is necessary at the driving side to stop the shaft radially always at the same point in order to avoid any phase shift in view of the bevel gear.

Instead of the shaft hydraulic sliders, magnetic couplings or the like can be provided which interrupt the drive and switch it on again. The switching-on and -off time is determined by means of an information carrier. The shuttle and thread supply carriers running idle at the beginning immediately take part again in the embroidery process and do not influence the quality of the embroidery product negatively.

Independent therefrom at both sides catching the thread cut can be obtained, if with predetermined patterns with long, exposed threads tangling from one stitch to the other could result. Basically, with the subject invention it is required that all elements working together in the embroidery process are brought into the embroidering position simultaneously and synchronously to each other. This is true for the embroidering head, the shuttle casing and the shuffle-driver bar. The adjusted position of the embroidering head and shuttle casing will be retained during the embroidering operation, which means that embroidering head and embroidering casing remain in their resting position during the embroidering step. The shuttle driver bar is being moved during the embroidering operation, it is to be maintained in the newly adjusted position, because it moves along an axially oscillating path.

Positioning embroidering head, shuttle casing and shuttle driver bar always is done when the embroidery machine is at rest. Whereas the drives for the continuous adjustment of the embroidering heads and the shuttle casing is to be firmly connected with the adjustment gears the drive for the driver bars will be arranged so that it can be coupled and decoupled.

The foregoing description of the invention is based on a machine structure of rather high expenditure, with which the embroidering motives can be formed at will. E.g. the relative synchronous adjustment of the embroidering stations is performed automatically within a card passage or alternatively the embroidery motifs are not within a card passage and are completely independent from the pattern programming. A corresponding relative synchronous adjustment of the embroidering stations within the entire embroidering field only is required to be performed once and is correct as long as such an embroidering motive is to be embroidered. Because completely new designs will be obtained (e.g. with a single embroidering operation embroidering motives can be introduced into the embroidering ground, e.g. in network) simultaneously in a horizontal line or in a zig-zag-line so that long term machine holding times are obtained. Therefore, esp. for those purposes it is not necessary to use a complex mechanism but rather a simple hand adjustment can be chosen by simple auxiliary means.

With the continuous height adjustment of the basic guides, e.g. in the form of double basic guides the embroidering technique also can make use of the knitting technique; the embroidery motive can be mixed by altering the positions of the basic guides and by positioning the embroidering stations. Furthermore, costs and expenditure for varying the pattern can be considerably reduced.

Other and further objects will be apparent to those skilled in the art upon consideration of the drawings when considered in connection with the description thereof hereinbelow.

BRIEF DESCRIPTION OF THE DRAWINGS

FIG. 1 is a schematic illustration of a basic guide according to the invention at a predetermined position of the embroidering heads being arranged one above the other;

FIG. 2 is a view similar to that one of FIG. 1 with a modified position of the embroidering heads;

FIG. 3 is a cross section of FIG. 1 along the line A–B of FIG. 1;

FIG. 4 is a lateral part view of parts of the drawing of FIG. 2 in the direction of arrow C.

In FIG. 1 one basic guide is shown with embroidering heads 1, 2, 3, 4, 5 which are arranged one above the other in a vertical manner and spaced in an equal distance. The individual embroidering heads are individually mounted on pairs of adjustment bars 6, 6*a*; 7, 7*a* and 8, 8*a*. The adjustment bars are movable relative to each other in an axial vertical direction, e.g. by means of distance screws 9, 10 and slotted holes 11, 12 (FIGS. 2 and 4). The same is true for both halves X and Y of a basic guide, which are guided in the same manner (FIG. 3).

Figure 5:
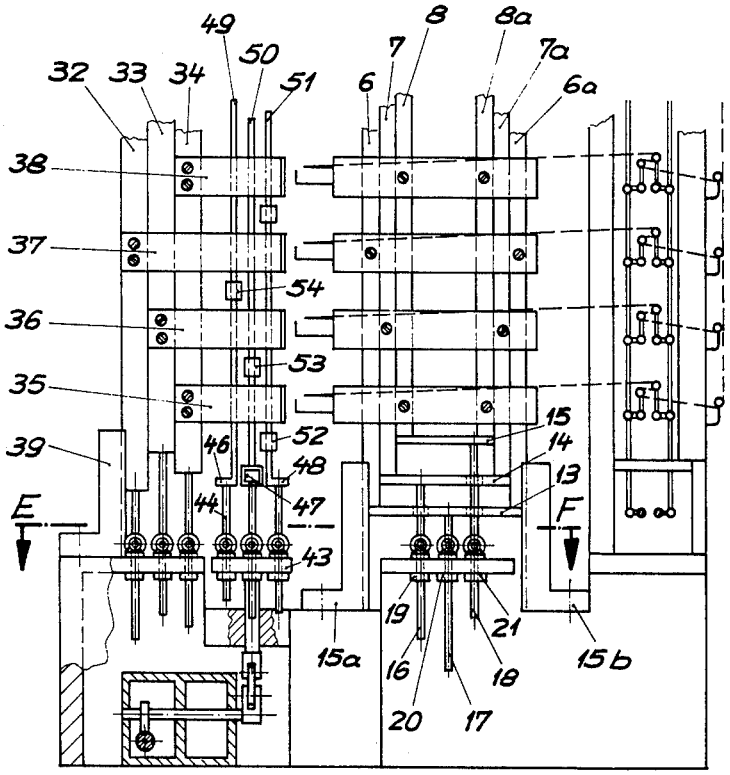
FIG. 5 is a lateral view of the drive connection for the individual embroidering heads in a decreased scale in view of the illustration of FIG. 1 or 2.

The corresponding pairs of adjustment bars 6, 6*a*; 7, 7*a*; 8, 8*a* (as can be seen from FIG. 5) are connected to each other at their lower ends by girders 13, 14, 15 and are guided in guides 15*a*, 15*b*. Threaded spindles 16, 17, 18 are mounted on the girders 13, 14, 15 which spindles operate with stationary, however, rotatably supported nuts 19, 20, 21. The pairs of adjustment bars 6, 6*a*; 7*a*, 7; 8, 8*a* of one half of a basic guide are connected through angle drive gears 22, 23, 24 and shafts 25, 26, 27 (FIG. 8) to the central adjustment gear box 28. The angle gear shafts 29, 30, 31 form the driving connection to further basic guides.

Corresponding to the adjustment bars of the embroidering heads 1–5 adjustment bars 32, 33, 34 for the shuttle casings are provided which are supported in guides 39. Corresponding angle gear drives with thread spindles and nuts are provided similar to the embroidering heads, the driving shafts 41, 42, 40 of which also are driven by the adjustment gear box 28.

Figure 7:
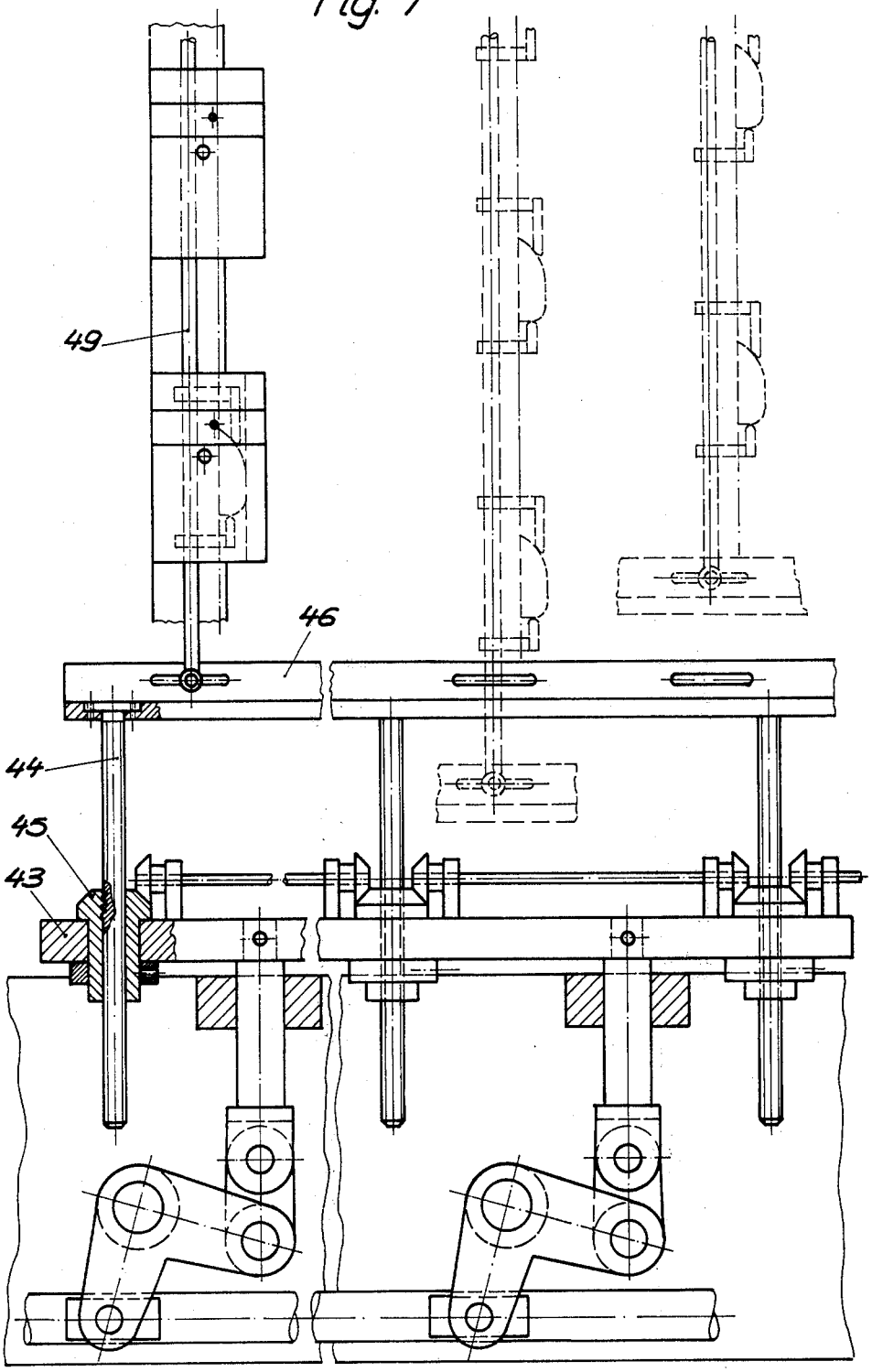
FIG. 7 is a lateral view of the drive of a shuttle driver bar (part of FIG. 5)

As can be seen from FIG. 7 the girder 43 extending over the entire embroidery field width is given a rectilinear, vertical movement by means of its drive. Threaded spindles 44 and nuts 45 on the girder 43 are provided corresponding to those for the adjustment of embroidering heads and the shuttle casings, which spindles and nuts support upper girders 46, 47, 48 (FIG. 5), which are connected to driver bars 50, 51, 49 each. On the driver bars the shuttle drivers 52, 53, 54 are adjustably screwed; they are required for taking along the shuttle in a vertical direction.

Figure 6:
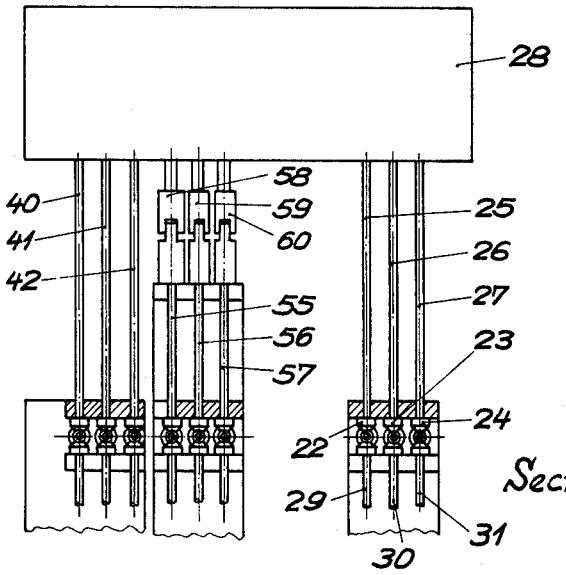
FIG. 6 is a top view of the drive connection according to FIG. 5 along line I–F.

According to the shafts 25, 26, 27; 40, 41, 42 the shafts 55, 56, 57 (FIG. 6) are connected to the adjustment gear box 28, however, by means of the switchable couplings 58, 59, 60 which are to be switched off during the embroidering operation, because the girder 43 is in movement. The adjustment gear only is operated if the embroidery machine is at rest and if the driver bars are in their dead centre so that the coupling operation through the couplings 58, 59, 60 is guaranted.

The adjustment gear within casing 28 is provided in such a manner that the adjustment path of the connected three driving elements is obtained in synchronism as it is absolutely necessary for a proper operation between needle and shuttle.

Besides of a predetermined adjustment of individual embroidering heads within one half of a basic guide it is also possible to adjust one half of the basic guide relative to the other in its entirety.

Figures 8, 9, 10:
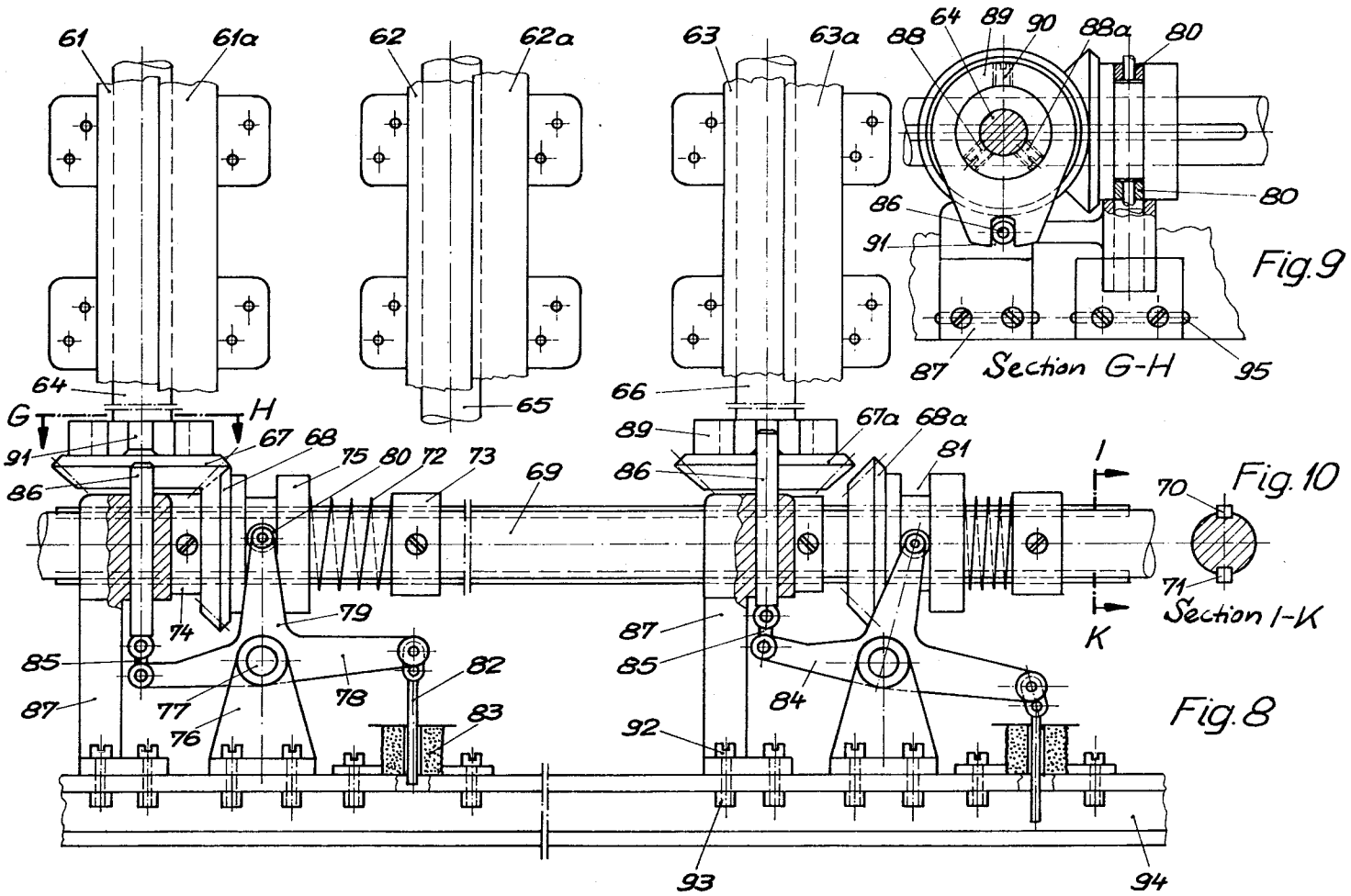
FIG. 8 shows means for automatically switching on and off the basic guides.
FIG. 9 is a partial sectional view along line G–H of FIG. 8.
FIG. 10 is a partial sectional view along line I–K of FIG. 8.

In FIG. 8 two basic guide halves 61 and 61*a* or alternatively 62 and 62*a* or 63 and 63*a* which belong to a drive 64, 65, 66 are driven by means of bevel gears 67 and 68 or 68*a* from a common main shaft 69. In order to individually switch off one of the drives 64, 65 or 66 at will the bevel gear 68 is provided as a shift wheel, which obtains its form-locking condition with the main shaft 69 by means of springs 70 and 71. In order to allow a positive mesh of the bevel gears 67 and 68 a pressure spring 72 is provided which is supported on an axially adjustable positioning ring 73. The stop ring 74 which is adjustably mounted on shaft 69, holds the bevel gear 68 at distance so that the wheels 67 and 68 can roll in a proper manner on their partial circles.

The claw coupling 75 which is formed together with the bevel gear 68 into a complete part, can be shifted axially on the shaft 69. On a support 76 a three-arm lever 78 is provided which is pivotally supported around the axis 77 and the vertical arm 79 of which engages the roller 80 within the groove 81 of coupling 75; a horizontal arm is in connection with an armature 82 of an electromagnet 83. Said magnet, however, also can be substituted by other control elements, f.i. pneumatic hydraulic or mechanical control drives.

The control drive obtains its orders through an information carrier, which includes data at which position of an embroidery motive basic guides are to be switched off. Coming to rest always is obtained at the upper dead point of the needles of the embroidering heads, and it will be necessary for the drives 64 or 65 or 66 to maintain this position so that they will be able to operate again in the same rhythm with the remaining embroidering heads if the coupling 75 is switched on again through the bevel gears 67. Thus, the third arm 84 of lever 78 is coupled through a link 85 with an locking bolt 86, which is supported axially movable in a stationary support 87 (section G–H).

On the bevel gear 67 which is positively connected with shaft 64 by means of screws 88 and 88*a* the disc 89 is mounted which is radially adjustable by means of the screw 90 and is provided with a guide slot 91, with which the locking bolt 86 is able to engage.

According to the picture of FIG. 8 the coupled and decoupled positions are drawn and there can be seen how the bevel gears 67*a* and 68*a* are separated after the armature 82 has been attracted by the magnet 83, whereby at the same time bolt 86 engages the slot 91 and the shaft 64 is maintained in its starting position until after rest of the shaft 69 which rest is required before any switching operation the switching-in is effected again.

On the drive side it is necessary that the stop of the shaft 69 is obtained radially always at the same position so that no phase shift will be obtained in view of the bevel gear 67.

However, if e.g. only half of the embroidering heads of a basic guide which are arranged vertically above each other is to be switched off as this is true for obtaining special pattern effects this is to be obtained by switching rollers and switching bars, as already described. This is the case, because with the described device always both halves of a basic guide are switched off simultaneously.

Because the horizontal distance of the basic guides is to be variable continuously, also all elements which operate directly with the switching on and switching off of said basic guides are to be arranged non-stationary. For this purpose the supports 76 and 87 as well magnets 83 are fixed by means of screws 92 and nuts 93 on a bar 94 which is provided with slotted holes 95 similar to a perforation, so that a continuous movement is allowed. Because the distance of the elements 76, 83 and 87 from each other always is the same said elements also can be fixed together for one basic guide on a support and then can be fixed movable on the carrier 94. The elements provided on shaft 69 also can be brought into a new position in an easy manner and can be fixed at said position.

Figure 11:
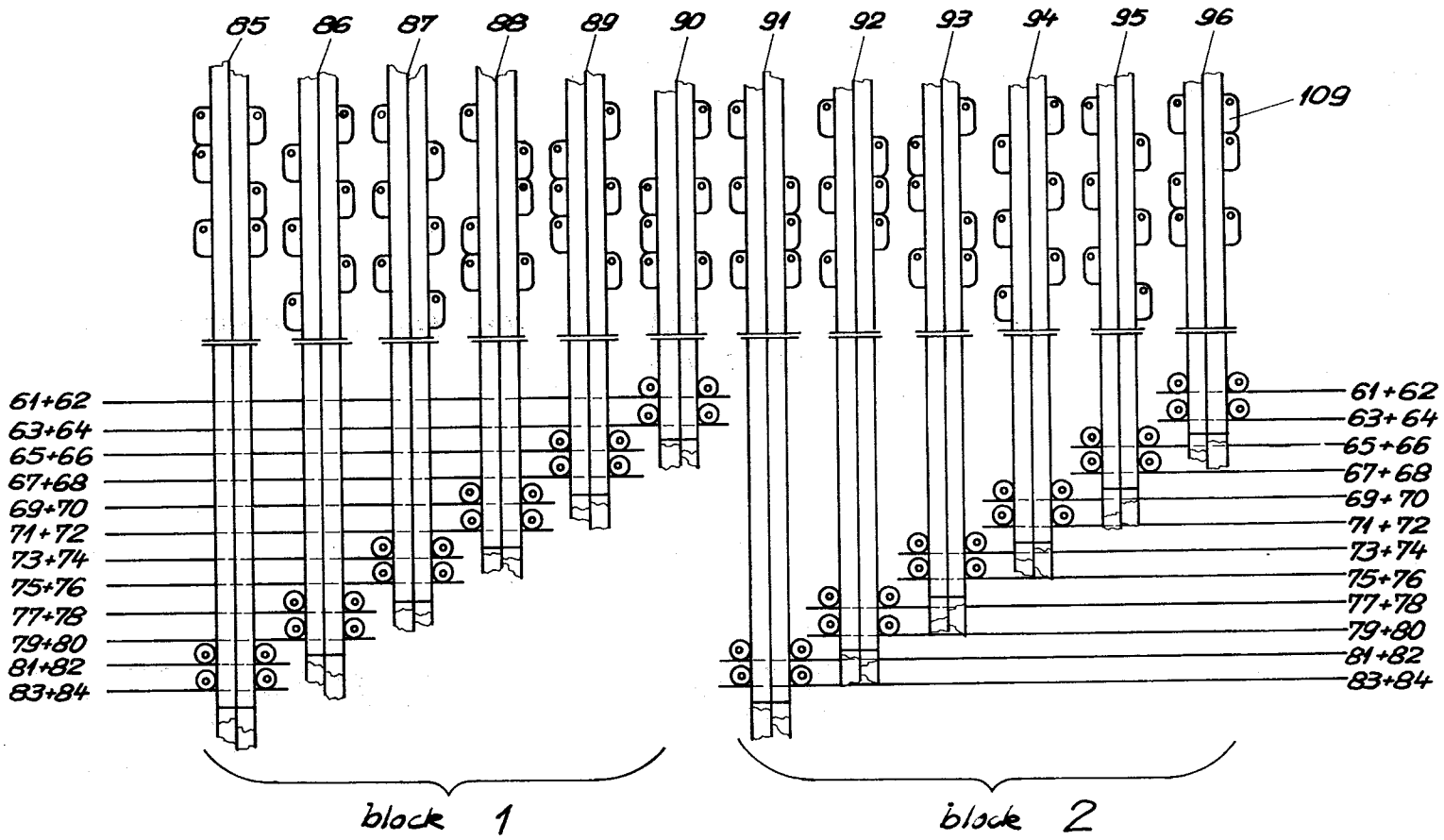
FIG. 11 shows schematically means for continuously adjusting the embroidering heads.
Figure 12:
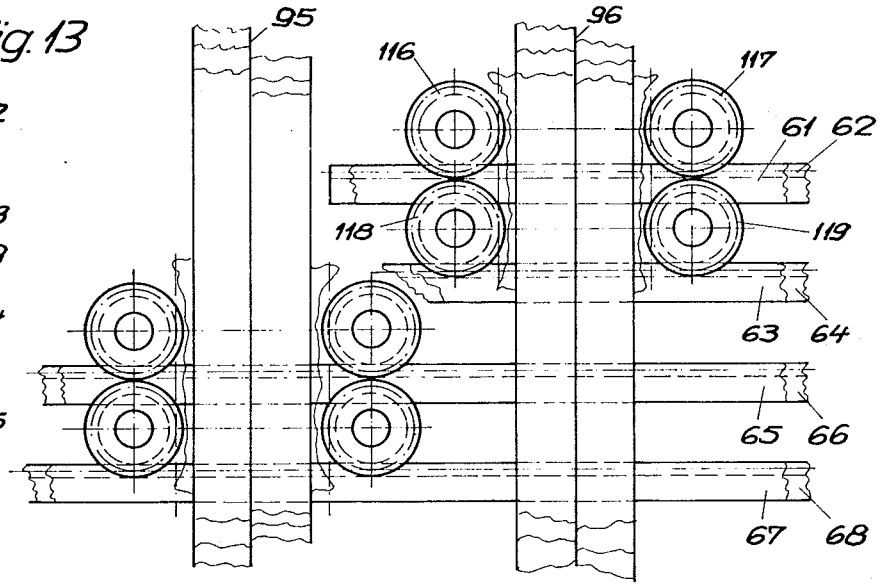
FIG. 12 is a detailled view of part of FIG. 11.
Figure 13:
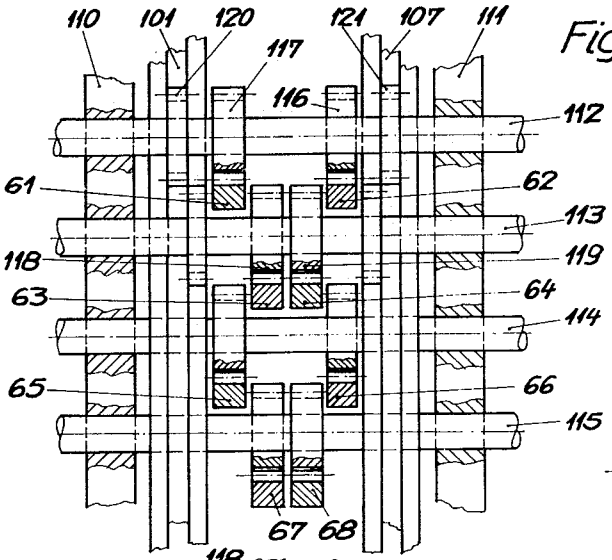
FIG. 13 is partly in cross section a lateral view turned around 90° in view of the picture of FIG. 12.
Figure 14:
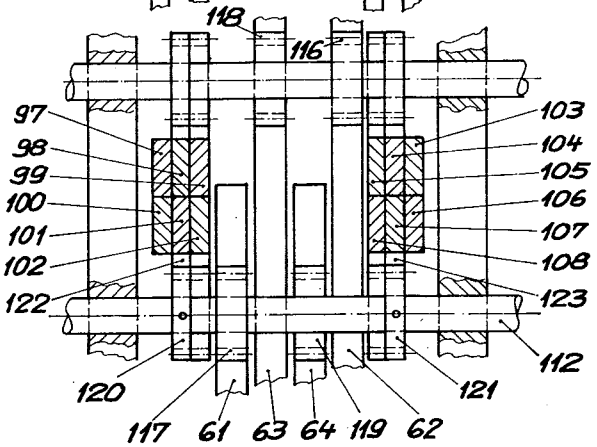
FIG. 14 is a top view of the picture of FIG. 13, partly in cross-section.

In FIGS. 11 until 14 the continuous adjustment of the embroidering heads is shown. FIG. 11 shows schematically how the drives of all pairs of basic guide girders are split up for continuous adjustment divided into block 1 and block 2. In this manner a smaller height of the machine will be obtained. 24 driving tie-rods belong to each block which tie-rods are formed as toothed racks, which join into a centre drive not shown. They are individually actuated by a signal from an information carrier. Each of the 12 basic guides 85–96 which are arranged distributed over the entire width of the embroidery field, consists of six girders 97–108, whereby always two opposite girders, as 97 and 103 or 101 and 107 do form a pair of girders, on which embroidering heads 109 are provided one above the other.

In stationary housing walls 110 and 111 shafts as 112, 113, 114 and 115 are supported on which spur gears 116, 117, 118 and 119 are mounted. Furthermore, on said shafts, as shaft 112, always two pairs of wheels, as 120 and 121 are provided which engage the toothed racks 122 and 123 and are screwed on to the girders 101 and 107. In this case 101 and 107 do form a pair of girders which pair when adjusted in height brings the embroidering head 109 mounted thereon into a changed position. With this embodiment it is provided that the pairs of girders 97–103 and 100–106 do not take part in an adjustment in height.

Figures 15, 16:
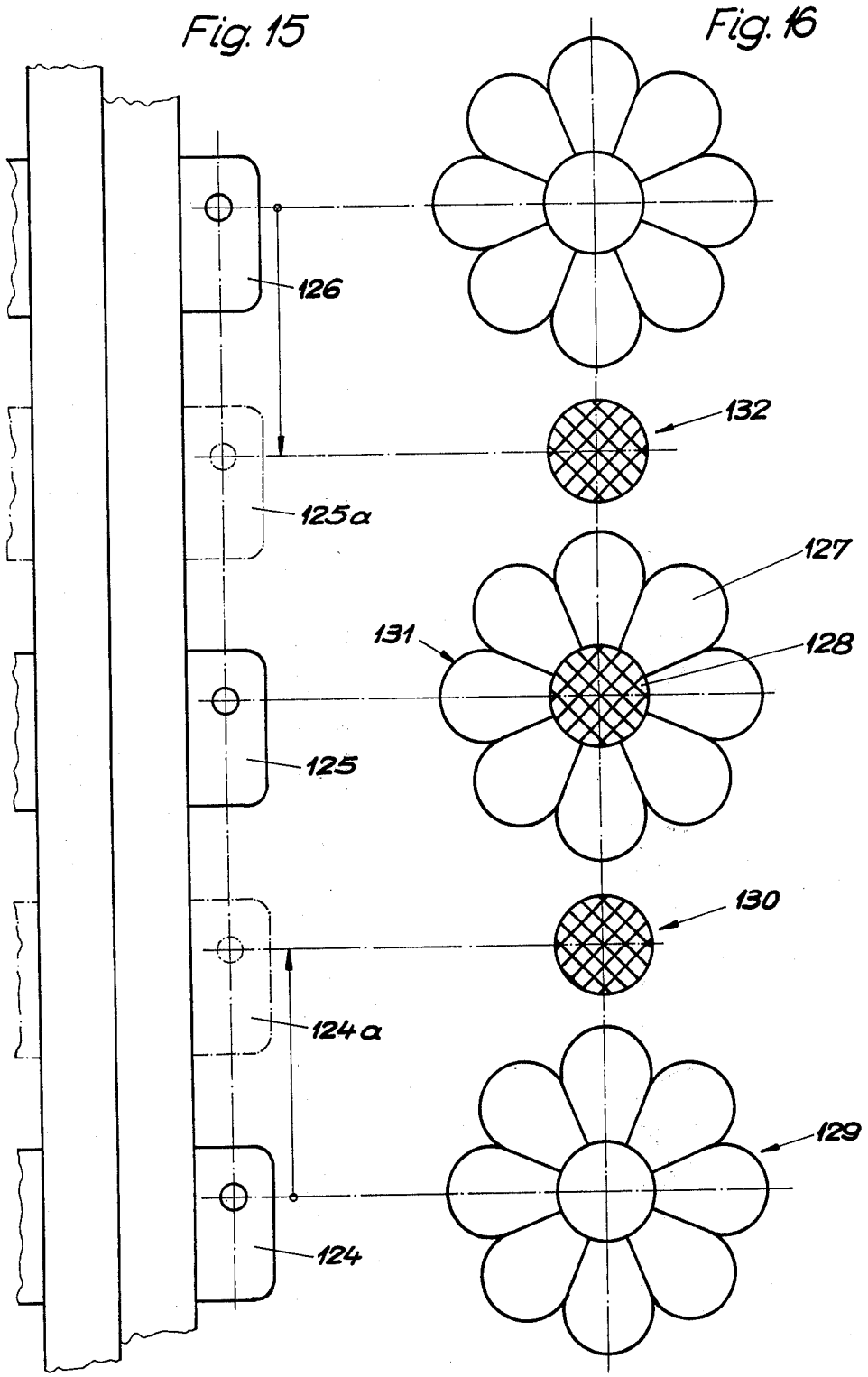
FIG. 15 is a schematic illustration of part of a basic guide with three embroidering heads, which are arranged one above the other and which are adjustable in height.
FIG. 16 is a flower pattern in a simplified form in order to show the use of the inventive machine for the new pattern technique, according to the picture of the positioning of the embroidering heads of FIG. 15, and FIGS. 17*a, b* and *c* show three different embroidery patterns with the corresponding double basic guides, which are shown schematically.

As can be seen esp. from FIGS. 15 and 16 the inventive machine allows a plurality of patterns because the continuous adjustment of embroidering heads, of the shuttle casings and the driver bars allows a nearly infinite number of different repeats in height. The heads 124 and 126 according to FIG. 15 can be brought continuously into position 124*a* and 126*a* or in any other intermediate position. The same is true for the embodiment according to FIG. 1, with which the embroidering heads 1–5 also are adjustable continuously at will.

FIG. 15 shows a single basic guide according to U.S. Pat. No. 3,680,505 in combination with which further basic guides at both sides are provided in any number.

Contrary to embroidery methods and embroidery machines used up to now with which embroidering stations are provided in one line side by side, the pattern 129, 130, 131, 132 shown in FIG. 16 is to be embroidered in four different card passages with corresponding embroidery ground shift each, this is done according to this invention with a single card or with a single passage of the card. Whereas all three embroidering stations 124, 125, 126 embroider the flower leaves 127 simultaneously in one passage the embroidery machine by means of the information carrier interrupts the entire embroidering operation and switches in a control mechanism which shifts the embroidering station 124 at the adjustment bar from position 124 into position 124*a* and the embroidering station 126 on a second adjustment bar downwardly from position 126 into 126*a*. The embroidering station 125 remains in the base position of the machine.

Subsequent to this positioning process the embroidering operation is taken up again through the information carrier and all three embroidering stations now embroider simultaneously the centre 128, 130, 132 of the flower. The base pattern of the flower 127 and 128 now is distributed over the area. The variation from these two base elements now can be done within the basic guides in the most manifold manner. Moreover, with the inventive machine it is possible that the adjacent basic guides produce the same pattern with a different adjustment, f.i. with a gap, in groups or the like. According to the invention it is also possible to interrupt any basic guides to be chosen within the embroidering process and to switch them on again so that the embroider and the designer obtain a large manifold of new possibilities. The pictures according to FIGS. 16 and 17 only show a simple embodiment of the manifold possibilities for the patterning. The adjacent basic guides also can be changed in view of the position of the embroidering stations close to each other so that over the entire width of the material web an arrangement of the repeats in wavelines, zig-zag-lines, closed groups, and so on will be obtained. However, it is also possible, to switch over from individual motives on a straight line onto staggered individual motives.

Figures 17A, 17B, 17C:
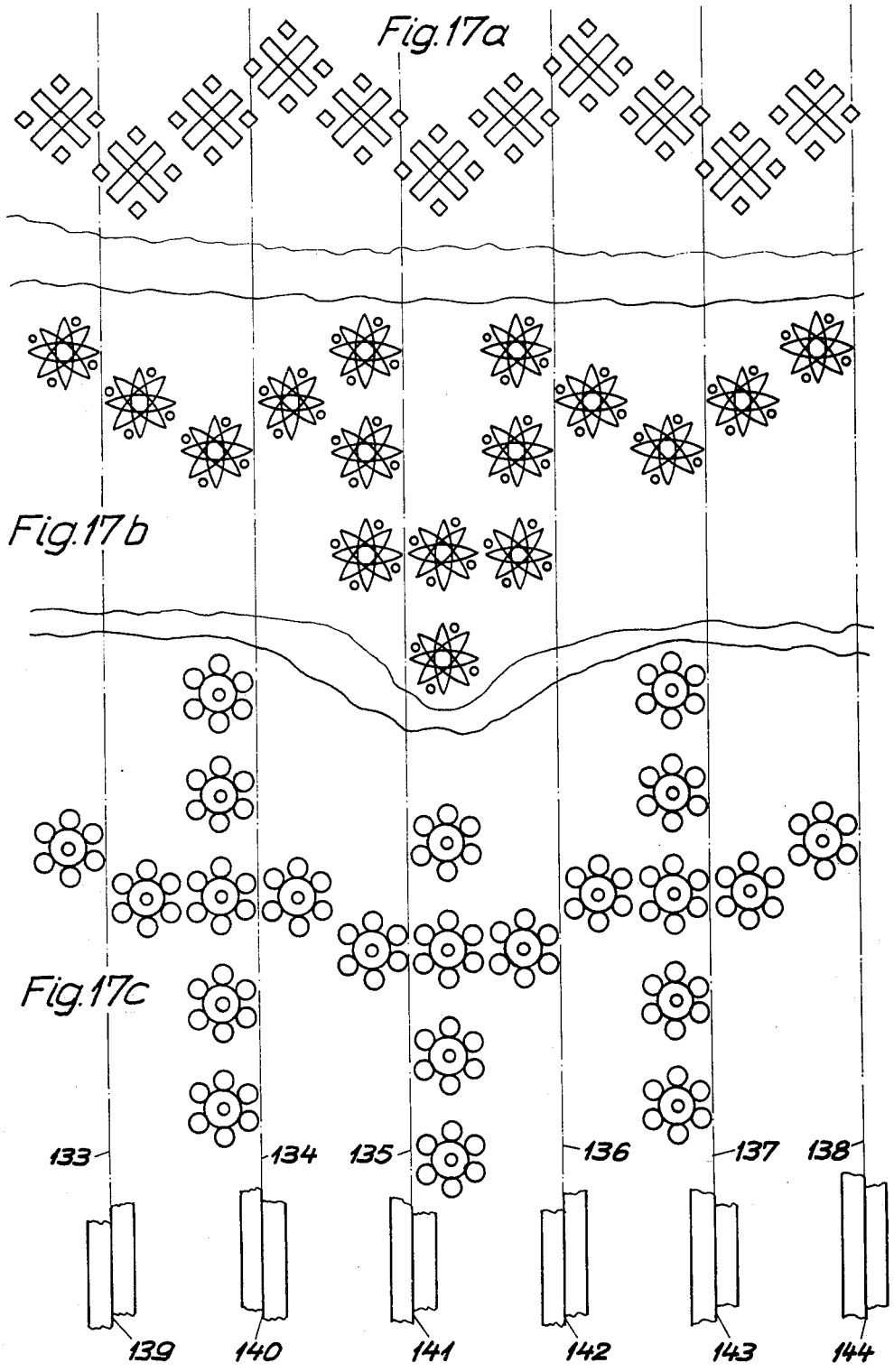

In FIGS. 17*a*, 17*b* and 17*d* three different embroidery patterns with the corresponding double-basic guides are shown. The centre lines 133–138 drawn through the centre of the basic guides do show that the motives drawn to the left of the centre lines do belong to the left half and those ones drawn to the right of the centre lines do belong to the right half of the double-basic guides 139–144. According to the adjustment in height of the basic guides nearly infinite variations of the patterning can be obtained as the three above mentioned examples do show.

In a simplified embodiment for hand adjustment e.g. each adjustment bar at the top end or the bottom end is provided with a toothed member mounted thereon and with a firm tension spring. In addition a scale for the toothing is provided in order to enable to read the adjustment height exactly. Said toothing is engaged by a pinion with a ratchet. The pinion e.g. is mounted to a support which is fixed to the upper or the lower machine transverse girder above or below the girder. The pinion is supported in such a manner that the non-supported part is provided as an extending square bar. Each adjustment bar thus includes a toothed end member the length of which corresponds to the length of the range of the height adjustment, which can be determined at will. The pinion engages the toothing and is pressed towards the pinion by means of a shiftable ratchet. The counter pressure is exerted by a strong tension spring. In this manner the adjustment bar cannot move laterally in its height.

If an adjustment of height is to be made at the needle side and also at the shuttle side the operator for readjusting the machine inserts a common ratchet into the square bar of the pinion, lifts the pinion to some extent in order to release the mesh of tooth, shifts the locking means and adjusts the corresponding adjustment bar to the required height or depth (which can be read from the scale). Subsequent to the height or alternatively depth adjustment of the corresponding adjustment bar the corresponding ratchet is inserted into the toothing again. The above mentioned tension spring restores the positive coupling by means of the counter pressure again. The ratchet will be released and the operator adjusts the adjacent adjustment bar which is to be adjusted according to the pattern.

An adjustment operation of this type is possible as well with the adjustment bars at the needle side according to FIG. 1, reference numeral 6 and 6*a*, 7 and 7*a*, 8 and 8*a* as well at the shuttle side according to FIG. 1, reference numerals 32, 33, 34.

In addition the driver bars according to FIG. 5, reference numerals 49, 50, 51 are to be split up at the bottom or top end and are to be connected similar to a threaded spindle or threaded sleeve. For an adjustment in height or alternatively depth the connection is released and the new distance is readjusted in a known manner and subsequent thereto the positive connection is made again. In the described manner one adjustment bar after the next is treated in the same manual manner as well on the needle side as on the shuttle side.

What I claim is:

1. An embroidering machine having a plurality of embroidering stations containing embroidering tools, said machine comprising:

embroidering heads, in which the embroidering tools of each embroidering station are combined on the needle side, casings for the embroidering tools on the shuttle side, basic guides, which extend over the height of the embroidery field and to which the embroidering heads and the casings are mounted, adjustment bars mounted to the basic guides at the needle side and at the shuttle side for supporting the embroidering heads, girders connecting the basic guides at the needle side and at the shuttle side for synchronously adjusting the embroidering tools of each embroidering station at the needle side and at the shuttle side, and driving means for moving the adjustment bars with respect to the basic guides.

2. An embroidering machine according to claim 1, wherein the embroidering tools on the needle side and on the shuttle side within the embroidering area are arranged on pairs of adjustment bars, which are adjustable in height relative to the basic guides.

3. An embroidering machine according to claim 1, wherein the adjustment bars are movably mounted in slotted holes by means of distance screws.

4. An embroidering machine acording to claim 1, wherein the pairs of adjustment bars are interconnected at their lower ends by girders and are guided in guides.

5. An embroidering machine according to claim 4, wherein the girders are connected to an adjustment gear by means of threaded spindles, miter gears and shafts.

6. An embroidering machine according to claim 5, wherein the drive shafts for the shuttle casing gear are driven by the adjustment gear.

7. An embroidering machine according to claim 1, wherein the adjustment bars for the shuttle casings are supported in guides.

8. An embroidering machine according to claim 1, wherein the height adjustment is automatically made by means of an information carrier.

9. An embroidering machine according to claim 8, wherein the height adjustment is made through miter gear shafts by means of toothed racks.

10. An embroidering machine according to claim 8, wherein the height adjustment is made hydraulically by means of stepping motors.

11. An embroidering machine according to claim 8, wherein the height adjustment is made by means of changable step discs, caming means or by means of chain and chain wheel.

12. An embroidering machine according to claim 1, wherein a girder is provided, which extends over the entire embroidery field width, and which is connected to the adjustment members by means of driver bars for the shuttle drivers.

13. An embroidering machine according to claim 12, wherein for continuous varying the horizontal distance of the basic guides the support means are mounted on a girder, which is provided with continuously adjustable means, e.g. slotted holes.

14. An embroidery machine according to claim 1, wherein shafts are connected to the adjustment bars through switchable couplings.

15. An embroidering machine according to claim 1, wherein driving means are provided for driving the embroidering stations combined within the basic guides on the needle side and on the shuttle side which driving means can be switched on and off.

16. An embroidering machine according to claim 1, wherein the drive shaft for needle and piercer is provided with a coupling in order to switch on and off basic guides, which coupling couples the drive shaft with the main drive of the machine in a releasable manner.

17. An embroidering machine according to claim 16, wherein the coupling is a claw coupling.

18. An embroidering machine according to claim 16, wherein the coupling is provided on a shaft transverse to the embroidery machine width.

19. An embroidering machine according to claim 16, wherein the coupling is arranged axially movable on the shaft.

20. An embroidering machine according to claim 16, wherein the switching-on and switching-off operation is controlled by program control means.

21. An embroidering machine according to claim 16, wherein a three-arm lever is arranged on support means in such a manner that one arm is connected to a control member, and that a third arm is supported axially movable by means of a locking bolt link.

22. An embroidering machine according to claim 1, wherein for a continuous adjustment of the embroidering heads shafts with bevel gears and wheel pairs are provided in stationary housing walls, which shafts engage toothed racks and operate together with basic guide girders.

* * * * *